US008268124B2

(12) United States Patent
Ako et al.

(10) Patent No.: US 8,268,124 B2
(45) Date of Patent: Sep. 18, 2012

(54) METHOD FOR PRODUCTION OF PULP

(75) Inventors: Akira Ako, Yokosuka (JP); Kazumasa Koike, Sagamihara (JP)

(73) Assignees: Nihon Cellulose Co., Ltd., Yokohama-Shi (JP); Kabushiki Kaisha Toa Kogyo, Fukaya-Shi (JP)

( * ) Notice: Subject to any disclaimer, the term of this patent is extended or adjusted under 35 U.S.C. 154(b) by 108 days.

(21) Appl. No.: 12/450,168

(22) PCT Filed: Jan. 15, 2008

(86) PCT No.: PCT/JP2008/051008

§ 371 (c)(1),
(2), (4) Date: Mar. 12, 2010

(87) PCT Pub. No.: WO2008/088077

PCT Pub. Date: Jul. 24, 2008

(65) Prior Publication Data

US 2010/0175841 A1 Jul. 15, 2010

(30) Foreign Application Priority Data

Jan. 15, 2007 (JP) ..... 2007-006159

(51) Int. Cl.
*D21C 3/16* (2006.01)
*D21C 1/06* (2006.01)

(52) U.S. Cl. ..... 162/81

(58) Field of Classification Search ..... 162/81
See application file for complete search history.

(56) References Cited

U.S. PATENT DOCUMENTS 2,110,545 A * 3/1938 Dreyfus ..... 162/81
4,652,341 A * 3/1987 Prior ..... 162/79

FOREIGN PATENT DOCUMENTS

| | | |
|---|---|---|
| JP | S58-132188 | 8/1983 |
| JP | H05-163690 | 6/1993 |
| JP | 2004-169203 | 6/2004 |
| JP | 2004-169204 | 6/2004 |
| JP | 2004-169205 | 6/2004 |
| JP | 2004-256925 | 9/2004 |
| WO | WO99/07936 | 2/1999 |

* cited by examiner

*Primary Examiner* — Anthony Calandra
(74) *Attorney, Agent, or Firm* — Manabu Kanesaka

(57) ABSTRACT

A pulp production process can produce pulp at high yield without using sodium sulfide and high-temperature/high-pressure conditions if compared with the Kraft process and also collect lignin. Pulp is produced by processing wood chips for hydrophlicization at room temperature, using a dilute caustic soda aqueous solution, selectively partially modifying lignin in dilute nitric acid and digesting the wood chips by means of a dilute caustic soda aqueous solution under the atmospheric pressure. Lignin is agglomerated and sorted out from the isolated black liquor.

13 Claims, 3 Drawing Sheets

Flowchart of Present Invention

Flowchart of Kraft Process

Flowchart of Present Invention

METHOD FOR PRODUCTION OF PULP

TECHNICAL FIELD

The present invention relates to a pulp production process that can production pulp at high yield without using sodium sulfide and high-temperature/high-pressure conditions if compared with the Kraft process and also collect lignin.

The present invention is aimed at utilization of lumber originating from buildings (wood debris from demolished wooden buildings, scrap wood from buildings, waste furniture and so on) as material for producing pulp.

BACKGROUND ART

As a result of enforcement of Construction Material Recycling Law (Law Concerning Recycling of Materials from Construction Work [Law No. 104 of May 31, 2000]), concrete blocks, asphalt concrete blocks and lumber originating from construction work are required to be sorted and recycled.

The Kyoto Protocol was voted in 1997 according to the United Nations Framework Convention on Climate Change and the target reduction ratios of the developed countries were determined relative to the reference emission levels of 1990 for carbon dioxide, methane, nitrogen monoxide, HFCs and sulfur hexafluoride. The target values are to be achieved by the jointly set time limit. The Kyoto Protocol was ratified by the Japanese Diet on May 31, 2002 and Japan deposited the instrument of acceptance in the United Nations on Jun. 4, 2004.

The determined target reduction ratios from the year of 2008 to the year of 2012 include 6% for Japan, 7% for United States of America and 8% for the European Union.

The present invention is intended to respond to the above-identified demand of the international society.

As for lumber originating from construction work, the target recycling ratio is set to 95% including reduced (incinerated) wood. Such wood is currently recycled after being crushed to wood chips in order to produce boards for particles, raw materials for paper producing, compost and so on and also for applications including mulching, thermal recycling (fuel) and chemical recycling. However, improper deposits (illegal dumping) of wood waste are frequently observed and fires have sometimes broken out as a result of spontaneous ignition of wood waste.

Wood is the most popular material that is being used in houses. However, many wood plates including those used for repairing are cross-laminated plates prepared by using paint and adhesive and hence can hardly be recycled to produce materials. In other words, most of them are thermally recycled (as fuel).

Lumber originating from construction work amounts to 9,000,000 tons per year only in the Kanto District in Japan. However, if wood waste is not reduced (incinerated) by thermal recycling but utilized as raw material for paper producing, a forest area that is two to three times as large as the forest area that needs to be destroyed to produce wood can be conserved on this planet because paper can be recycled two to three times. Then, the effect of supplying oxygen and suppressing carbon dioxide gas can be doubled or tripled.

While lumber originating from construction work is advantages when it is recycled as raw material for paper producing, the Kraft process that currently takes about 95% of the overall pulp production consumes high-quality wood chips as raw material for paper producing. In other words, lumber originating from construction work takes only a fraction of the overall pulp production in the world.

Currently, the Kraft process takes about 95% of the overall pulp production in the world, using wood chips as principal raw material. With this producing process, water, caustic soda and sodium sulfide are added to wood chips mainly obtained by crushing lumber cut out from woods to make them show a certain ratio and the materials are cooked (boiled) in a vessel at an average temperature of 160° C. under 6 to 7 atm for not less than 3 hours. Then, lignin that operates to bond the cellulose contained in the wood chips is continuously dissolved into the solution to isolate cellulose and hemicellulose from each other and produce pulp as lump of cellulose. The obtained pulp is generally referred to as fresh pulp. This process is the best pulp producing process in terms of cost performance at present.

Now, the Kraft process will be summarily described below by referring to FIG. 1 of the accompanying drawings.

Chips are sorted to make them show a thickness and a length that are found respectively within certain ranges and the dust is removed from them so that they may be cooked and digested uniformly.

In the Kraft digesting step, water and chemicals (caustic soda and sodium sulfide) are added to the chips to make them show a certain ratio and the materials are cooked (boiled) at 160° C. under 6 atm for not less than 3 hours to dissolve lignin.

In the subsequent washing step, the solution of the chemicals (caustic soda and sodium sulfide) containing the lignin dissolved in it (black liquor) is separated from the pulp, which is then washed with water.

In the delignification step, the lignin remaining in the pulp is eluted by means of oxygen and alkali.

In the filtering/refining step, the foreign materials such as dirt contained in the pulp is isolated and removed.

In the bleaching step, the pulp is bleached by means of a chemical selected from chlorine, chlorine dioxide, oxygen, caustic soda and sodium hypochlorite.

On the other hand, the black liquor is concentrated. The concentrated black liquor used as fuel within the process and collected as sodium carbonate.

Some Patent Documents relating to the Kraft process are listed below.

[Patent Document 1] JP 2006-274500-A

Patent Document 1 describes a process of turning green liquor, caustic.

[Patent Document 2] JP 2001-172888-A

Patent Document 2 describes a process of bleaching pulp.

[Patent Document 3] JP 11-286889-A

Patent Document 3 describes a PA process (hydrogen peroxide-alkali process) where hydrogen peroxide, a caustic alkali and a small amount of digestion promoter are used. It tells that hydrogen peroxide shows a delignification effect.

[Patent Document 4] JP 08-188976-A

Patent Document 4 describes that a surfactant and a chelating agent are added when bleaching chemical pulp by ozone.

[Patent Document 5] JP 08-502556-A

Patent Document 5 describes a process of bleaching pulp showing a high viscosity relative to permanganate number.

While the Kraft process provides the advantage of being able to produce high-quality paper, it is accompanied by the problems listed below.

(1) It utilizes wood chips obtained by cutting trees from forests as natural raw material. Many forests are destructed to meet the massive demand for wood chips, entailing a serious environmental problem.

(2) It requires a pressure vessel that can be used for digesting at 160° C. and under about 6 atm in order to elute lignin from wood. Then, a large facility has to be installed at high cost for such an operation. The running cost and the energy consumption rate of such a large facility are also high.

(3) Since lignin is dissolved at high temperature under high pressure, hemicellulose and cellulose are eluted partly to make the yield as low as about 50%.

(4) Since the digesting solution contains sodium sulfide, hydrogen sulfide, methyl mercaptan, dimethyl sulfide and dimethyl disulfide are produced from the digesting step, requiring anti-nuisance measures for the offensive odor they emit.

(5) Since the process consumes a large quantity of high-quality water, it requires an ample source of water and drainage disposal, which are costly.

(6) Since the yield of pulp production is about 50%, about 50% of the supplied wood is isolated in black liquor as lignin. Then, carbon dioxide gas is produced at a high rate as a result of condensation and incineration.

(N. B.) Lignin is a carbohydrate like cellulose and contains carbon at a ratio of $C(12)/CH_2(30)=0.4$. Lignin is produced by 1 ton as a result of producing 1 ton of pulp. Then, 0.4 tons of carbon turns to carbon dioxide when the lignin is incinerated.

$C:CO_2=12:44$. Thus, $0.4\times44/12-1.47$ tons of carbon dioxide are produced from 1 ton of lignin (0.4 tons of carbon).

(7) As clear from above, the process is for producing high-quality pulp exclusively from high-quality wood chips and hence is not related to producing pulp from lumber originating from construction work. Additionally, it produces carbon dioxide gas to a large extent.

DISCLOSURE OF THE INVENTION

Problems to be Solved by the Invention

In view of the above-identified problems, it is therefore the object of the present invention to provide a pulp production process that can employ lumber originating from construction work and does not require a pressure vessel to achieve a high yield without using pollutants such as sulfides and with a low water consumption rate nor use lignin as fuel.

Means for Solving the Problems

In an aspect of the present invention, the above object is achieved as by providing a novel pulp production process as defined below.

(1) A pulp production process characterized by comprising:

a hydrophilicizing step of hydrophilicizing wood chips by immersing into a dilute caustic soda aqueous solution;

a first washing step of removing the alkali component from the hydrophilicized wood chips obtained in the preceding step by adding water or warm water;

an oxidizing step of selectively partially oxidizing the lignin contained in the wood chips by adding dilute nitric acid to a first washed wood chips obtained as a result of said first washing step at room temperature or while heating them;

a second washing step of removing the dilute nitric acid from the wood chip obtained in said oxidizing step by adding water or warm water;

a digesting step of digesting the second washed wood chips obtained as a result of said second washing step by adding a dilute caustic soda aqueous solution and heating them; and a digested pulp/black liquor separating step of filtering the product of digestion obtained as a result of said digesting step and separating digested pulp and lignin-containing black liquor from each other.

(2) A pulp production process characterized by comprising:

a hydrophilicizing step of hydrophilicizing 1 weight portion of wood chips by immersing it in 5 to 20 weight portions of a caustic soda aqueous solution with a concentration of 1 to 10 wt % at 1.5 to 40° C. for 10 to 60 hours;

a first washing step of removing the alkali component from the hydrophilicized wood chips obtained in the preceding step by adding water or warm water;

an oxidizing step of selectively partially oxidizing the lignin contained in the wood chips at 80 to 98° C. for 40 to 120 minutes by adding 3 to 15 weight portions of a nitric acid aqueous solution with a concentration of 1 to 10 wt % to 1 weight portion of the first washed wood chips obtained as a result of said first washing step;

a second washing step of removing the nitric acid from the oxidized wood chip contained in said oxidizing step by adding water or warm water;

a digesting step of digesting 1 weight portion of the second washed wood chips obtained as a result of said second washing step by adding 5 to 20 weight portions of a caustic soda aqueous solution with a concentration of 1 to 20 wt % and heating them at 95 to 100° C. under the atmospheric pressure or higher pressure for 30 to 120 minute; and a digested pulp/black liquor separating step of filtering the product of digestion obtained as a result of said digesting step and separating digested pulp and lignin-containing black liquor from each other.

(3) Preferably, a pulp production process as defined in (1) or (2) above is characterized in that the hydrophilicizing step, the oxidizing step and/or the digesting step are conducted under low pressure (e.g., 1 to 2 atm).

(4) Preferably, a pulp production process as defined in any one of (1) through (3) above is characterized in that the digesting step is divided in a first stage digesting step and a second stage digesting step and the first stage digesting step employs an caustic soda aqueous solution with a caustic soda concentration lower than the caustic soda aqueous solution that the second digesting step employs.

(5) Preferably, a pulp production process as defined in any one of (1) through (4) above is characterized in that hot water is introduced after the oxidizing step to accelerate the oxidizing reaction rate of nitric acid so as to completely consume the nitric acid.

(6) Preferably, a pulp production process as defined in any one of (1) through (5) above is characterized in that wood chips are those of lumber of one or more types including lumber obtained by cutting trees in forests, lumber from thinning and lumber originating from construction work.

(7) Preferably, a pulp production process as defined in any one of (1) through (6) above is characterized in that lignin is agglomerated and sorted out from the lignin-containing black liquor.

Advantages of the Invention

As described above, the present invention provides a pulp production process that may not use lumber originating from construction work and does not require a pressure vessel nor use pollutants such as sulfides, consuming water only at a small rate while not using lignin as fuel.

BEST MODE FOR CARRYING OUT THE INVENTION

Sodium sulfide is added to the digesting step of the Kraft process by means of a high-concentration caustic soda aqueous solution and lignin is processed at high temperature under high pressure so as to be oligomerized and prevented from being polymerized back by sodium sulfide. Caustic soda dissolves lignin and is consumed to neutralize organic acids and saponify the resin content.

According to the present invention, lignin is selectively oligomerized by means of a dilute nitric acid aqueous solution that operates as strong oxidant prior to the digesting step and a dilute caustic soda aqueous solution is employed for the digesting step under mild conditions including the atmospheric pressure and a low temperature below the boiling point in order to elute lignin, while preventing the lignin from being further oligomerized, so as to allow lignin from being condensed and separated from the black liquor.

Figure 1:
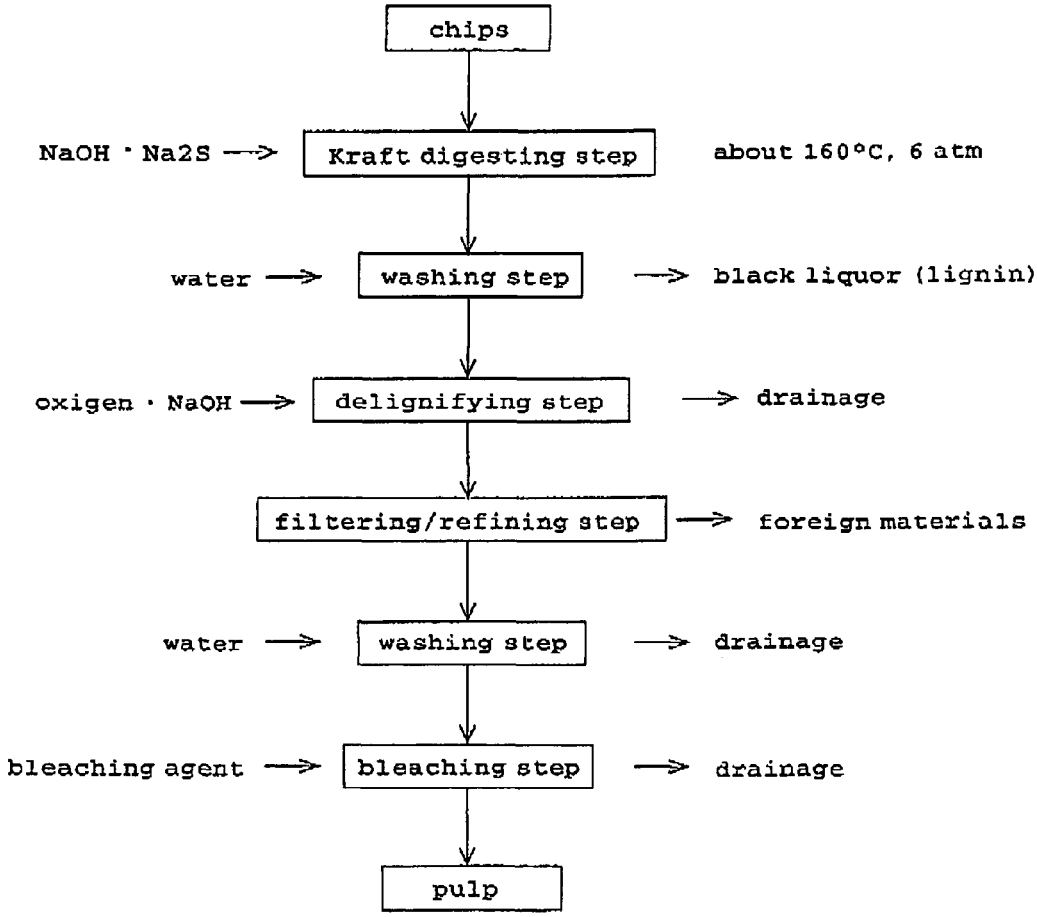
FIG. 1 is a schematic view of flowchart of the Kraft process.
Figure 2:
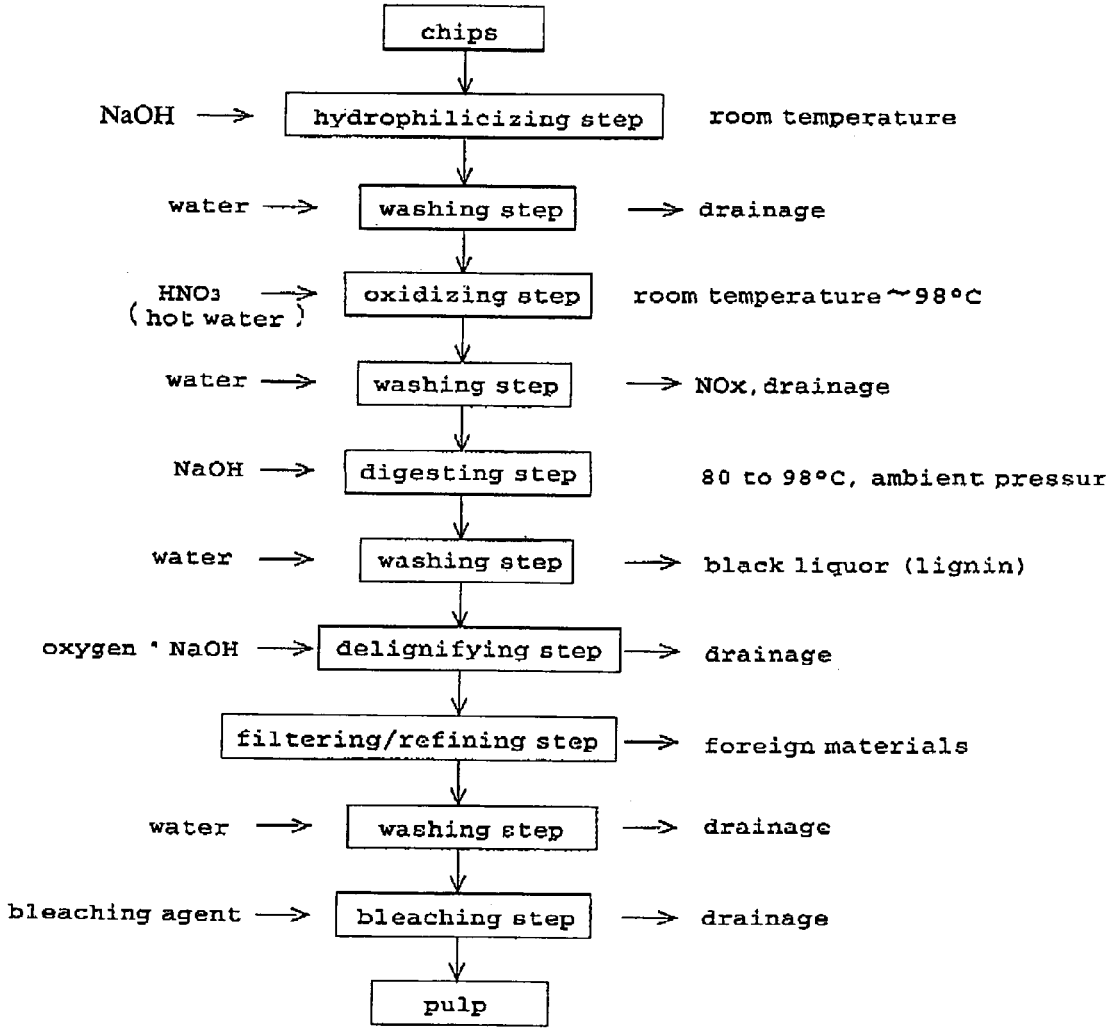
FIG. 2 is a schematic view of flowchart of a process according to the present invention.

Now, the present invention will be described further by referring to the flowchart of FIG. 2.

Wood chips obtained by crushing lumber produced by cutting trees in forests and/or wood chips obtained by crushing lumber originating from construction work (wood debris of demolished wooden buildings, building wastes, waste veneer, CCA materials and so on) and eliminating impurities (metal articles, nail, cement, bonded plates and so on).

While the chip size may vary depending on the type thereof, it is within a range suitable for being processed by chemical solutions (several millimeters to tens of several millimeters).

In the hydrophilicizing step, wood chips obtained by crushing lumber is immersed into a dilute caustic soda aqueous solution (with a concentration preferably of 1 to 10 wt %, more preferably of 1 to 5 wt %) at room temperature under the atmospheric pressure for tens of several hours (preferably 10 to 50 hours).

As low concentration caustic soda permeates into the fibers of the wood chips through internal pores of the fibers, the wood fibers is turned hydrophilic under the effect of hydroxy ions.

The concentration of the dilute caustic soda aqueous solution is preferably 1 to 10 wt %. The desired effect is not achieved when the concentration is less than 1 wt %, whereas the load of the subsequent washing step is raised when the concentration exceeds 10 wt % because dilute nitric acid is employed in the washing step.

The hydrophilicizing operation of the hydrophilicizing step is facilitated when the chips are immersed in water prior to processing them by means of a dilute caustic soda aqueous solution.

In the washing step, the alkali component is preferably thoroughly removed for the oxidizing operation in the subsequent oxidizing step:

In the oxidizing step, the hydrophilicized chips are immersed in a dilute nitric acid aqueous solution (with a concentration preferably of 1 to 10 wt %) to selectively partially oxidize lignin and encourage oxidation/decomposition and oligomerization thereof.

Dilute nitric acid shows a strong oxidizing effect as indicated by the reaction formula shown below:

$$2HNO_3 \rightarrow 2NO + 5[O] + H_2O,$$

where [O] represents an oxygen radical (active oxygen) that is highly reactive and has a very short life.

Thus, the C—O—C bonds, the CC bonds and the C═O bonds found in lignin are broken to realize oxidation/decomposition and oligomerization.

When the above reaction system of dilute nitric acid is stained, the stains operate as catalyst to accelerate the reaction by heating. Additionally, since the reaction proceeds very fast at about 80° C., the oxidizing condition in the oxidizing step can be maintained in a well controlled manner throughout the oxidizing step when pulp and dilute nitric acid are introduced into the oxidizing process at room temperature and subsequently raising the temperature to about 98° C.

It is effective to blow steam into the vessel, through the bottom thereof for the purpose of heating and/or agitation.

It is adequate to continue this treatment for tens of several minutes.

$O_2$ and $NO_2$ are produced by a side reaction of [O] and gas containing NO and $NO_2$ is collected from the top of the vessel.

It is adequate to collect NO and $NO_2$ and reuse them as source materials of nitric acid because they are nitrogen oxides ($NO_x$).

The Ostwald process is known as industrial process for producing nitric acid that proceeds as shown below.

$$2NO + O_2 \rightarrow 2NO_2$$

$$3NO_2 + H_2O \rightarrow 2HNO_3 + NO \text{ (NO is recycled)}$$

The NO and $NO_2$ produced by this step can be collected under the form of nitric acid by employing the Ostwald process.

As for the oxidizing step, hot water is preferably introduced at the end of the oxidizing step for the purpose of heating in order to completely conclude the reaction of decomposing nitric acid. As a result of this operation, the residual nitric acid, if any, is substantially completely consumed for the reaction and hence eliminated.

Lignin is scarcely eluted in the oxidizing step.

The NO and $NO_2$ that are produced in this step are collected with those of the preceding step.

In the subsequent washing step, chips are separated the eluted small-amount lignin and drug solution from each other, and is washed with water.

In the digesting step, chips and a dilute caustic soda aqueous solution (preferably with a concentration of 1 to 20 wt %) are heated (preferably at 95 to 100° C. for 30 to 120 minutes) to dissolve lignin.

The caustic soda aqueous solution dissolves lignin and also is consumed to neutralize organic acids and saponify the resin contents.

The duration of the digesting step is more preferably 30 to 60 minutes.

All the contained lignin is substantially dissolved (by not less than 95%) in this step.

The concentration of dilute caustic soda aqueous solution is more preferably 1 to 10 wt %. The process of dissolving lignin practically does not proceed when the concentration is less than 1 wt %, whereas lignin is dissolved without any problem but caustic soda is discharged as waste that does not take part in the reaction and/or the lignin concentration becomes too high in the black liquor to obstruct the process of agglomerating and sorting out lignin from the black liquor when the concentration exceeds 10 wt %.

The digested pulp and the black liquor are separated from each other and the pulp is washed with water in the subsequent washing step before the lignin is fed to the next step.

While the black liquor contains lignin to a concentration of not more than several %, lignin can be sorted out with ease by agglomerating because the lignin concentration in the black liquor is low.

The known process can be applied to the digested pulp.

In the delignification step, the lignin and the oxygen remaining in the pulp are eluted further, by means of alkali.

In the filtering/refining, the foreign materials such as dirt is isolated and removed.

In the bleaching step, the pulp is bleached by means of a chemical selected from chlorine, chlorine dioxide, oxygen, caustic soda and sodium hypochlorite.

According to the present invention, lignin is agglomerated, sorted out and recycled as resource. An electrolytic treatment technique and a water treatment technique can be applied for the purpose of treating waste water and collecting chemicals. Organic substances are sorted out and recycled as resource. Water, sodium and chlorine also can be recycled by applying an electrolytic treatment technique.

Example

While an example is described below, the present invention is by no means limited by the example.

Figure 3:
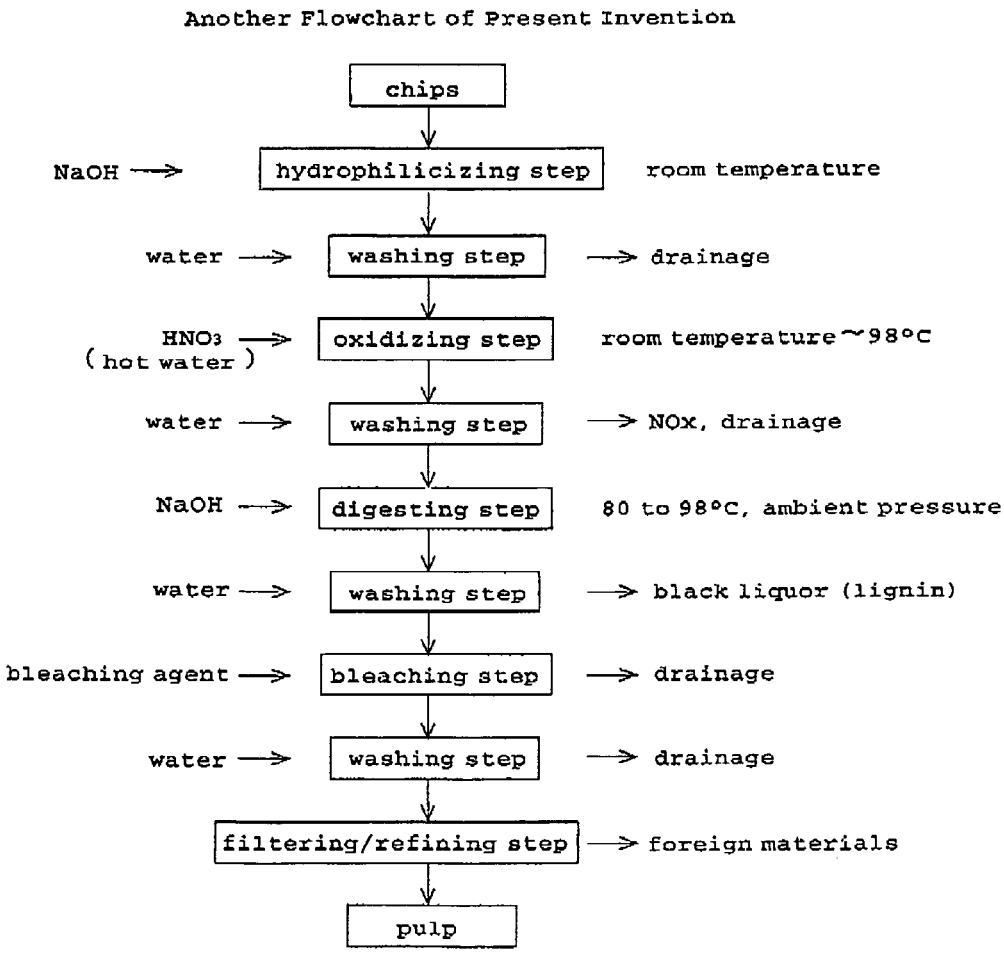
FIG. 3 is schematic view of another flowchart of a process according to the present invention.

The process of the example will be described below by referring to the flowchart of FIG. 3.

Lumber (veneer) was roughly crushed by means of a crushing machine (not shown) containing rotary claws and further crushed secondarily. Then, wood chips with a size not greater than 50 mm were sorted out from the crushed product. They were repeatedly subjected to a crushing/sorting operation until the obtained wood chips showed a size of 3 to 15 mm. In this way, desired wood chips were prepared.

In the hydrophilicizing step, the wood chips were immersed in a dilute caustic soda aqueous solution with a concentration of 5 wt %. The solution temperature was held to the room temperature and the step was continued for 50 hours.

While inter-step Washing was required for the process that will be described below, the description thereof is omitted from the following description.

The oxidation treatment tank is a vessel that can be hermetically sealed. The hydrophilic-treated chips were put into an oxidation treatment tank with a dilute nitric acid aqueous solution showing a concentration of 5 wt % at room temperature and steam was blown in from below. The mixture was heated and agitated slowly for an oxidizing process. The internal temperature of the treatment tank got to 80° C. after 40 minutes. Bubbles were generated fiercely as the internal temperature of the treatment tank rose and the heating was suspended temporarily when the bubbling was too fierce. Gas containing NO was collected from an upper part of the oxidation treatment tank. Although lignin was selectively partially oxidized, the quantity of eluted lignin was small.

Hot water was added and the inside of the treatment tank was heated to continue the oxidizing process. Bubbles started to be generated when the process temperature got to 98° C. and the reaction came to end.

The chips produced after the oxidizing process was washed put into a digestive tank with a caustic soda aqueous solution with a concentration of 5 wt % and steam was blow into the digestive tank from below. The mixture was boiled and agitated. The process was made to continue for an hour after the process temperature got to 98° C.

10 weight portions of a caustic soda aqueous solution, 10 weight portions of a nitric acid aqueous solution and 10 weight portions of caustic soda aqueous solution were added to 1 weight portion of the wood chips being treated in the hydrophylicizing step, in the oxidizing step and in the digesting step, respectively.

After the treatment process, the digested pulp and the black liquor were separated from each other. While lignin was agglomerated and sorted out from the black liquor, the lignin contained in the chips was eluted by not less than 95%.

After washing the digested pulp, the lignin remaining in the pulp were eluted further by means of oxygen and alkali and the pulp was bleached in the bleaching step by means of sodium hypochlorite. The pulp obtained as a result was equivalent to pulp that can be obtained by means of the Kraft process. The foreign materials such as dirt contained in the pulp were separated from the latter in the filtering/refining step.

Paper was produced by means of the pulp obtained in this example and subjected to a test. Tables 1 and 2 summarily illustrate the obtained results.

Since the paper of this example was light because it was handmade paper. However, the physical properties and the composition of the paper are equivalent to those of paper produced from Canadian lumber.

TABLE 1

Characteristic values of the produced paper

| Test item | Number of times of tests | Average | Maximum value | Minimum value | Standard deviation |
|---|---|---|---|---|---|
| Basis weight ($g/m^2$) | 10 | 96.5 | 102 | 89.9 | 3.64 |
| Tensile strength (kN/m) | 10 | 1.25 | 1.48 | 0.971 | 0.172 |
| Tear strength (mN) | 10 | 224 | 253 | 198 | 18.0 |
| Bursting strength (kPa) | 20 | 45.2 | 54.9 | 38.3 | 4.42 |
| Anti-bending strength ($log_{10}$ times) | 10 | 0.06 | 0.30 | 0.00 | 0.127 |
| ISO brightness (%) | 10 | 67.50 | 67.90 | 66.70 | 0.429 |

TABLE 2

Results of the ingredients analysis of the pulp

| Ingredient | Dry weight ratio (%) |
|---|---|
| cellulose | 95.4 |
| hemicellulose | 2.2 |
| lignin + impurities | 2.3 |
| resin | 0.1 |

The invention claimed is:

1. A pulp production process, comprising:

a hydrophilicizing step of hydrophilicizing wood chips by immersing the wood chips into a dilute caustic soda aqueous solution at room temperature for 10 to 60 hours thereby obtaining hydrophilicized wood chips;

a first washing step of removing alkali component from the hydrophilicized wood chips by adding water or warm water thereby obtaining first washed wood chips;

an oxidizing step of selectively partially oxidizing lignin contained in the first washed wood chips by adding dilute nitric acid to the first washed wood chips at room temperature or while heating a mixture of the first washed wood chips and the dilute nitric acid;

a second washing step of removing nitric acid from the wood chips obtained in said oxidizing step by adding water or warm water thereby obtaining second washed wood chips;

a digesting step of digesting the second washed wood chips by adding another dilute caustic soda aqueous solution and heating a mixture of the second washed wood chips and the another dilute caustic soda aqueous solution thereby obtaining digested product; and a digested pulp/black liquor separating step of filtering the digested product and separating digested pulp and lignin-containing black liquor from the digested product thereby producing pulp.

2. A pulp production process, comprising:

a hydrophilicizing step of hydrophilicizing 1 weight portion of wood chips by immersing the wood chips in 5 to 20 weight portions of a caustic soda aqueous solution with a concentration of 1 to 10 wt % at 15 to 40° C. for 10 to 60 hours thereby obtaining hydrophilicized wood chips;

a first washing step of removing alkali component from the hydrophilicized wood chips by adding water or warm water thereby obtaining first washed wood chips;

an oxidizing step of selectively partially oxidizing lignin contained in the first washed wood chips at 80 to 98° C. for 40 to 120 minutes by adding 3 to 15 weight portions of a nitric acid aqueous solution with a concentration of 1 to 10 wt % to 1 weight portion of the first washed wood chips;

a second washing step of removing nitric acid from the wood chips obtained in said oxidizing step by adding water or warm water thereby obtaining second washed wood chips;

a digesting step of digesting 1 weight portion of the second washed wood chips by adding 5 to 20 weight portions of another caustic soda aqueous solution with a concentration of 1 to 20 wt % and heating a mixture of the second washed wood chips and the another caustic soda aqueous solution at 95 to 100° C. under atmospheric pressure or higher pressure for 30 to 120 minutes thereby obtaining digested product; and a digested pulp/black liquor separating step of filtering the digested product and separating digested pulp and lignin-containing black liquor from the digested product thereby producing pulp.

3. The pulp production process according to claim 1, wherein the hydrophilicizing step, the oxidizing step and/or the digesting step are conducted under low pressure.

4. The pulp production process according to claim 1, wherein the digesting step is divided in a first stage digesting step and a second stage digesting step, and the first stage digesting step employs a caustic soda aqueous solution with a caustic soda concentration lower than the caustic soda aqueous solution that the second digesting step employs.

5. The pulp production process according to claim 1, wherein hot water is introduced after the oxidizing step to accelerate an oxidizing reaction rate of nitric acid so as to completely consume the nitric acid.

6. The pulp production process according to claim 1, wherein the wood chips are lumber obtained by cutting trees in forests, lumber from thinning and lumber originating from construction work.

7. The pulp production process according to claim 1, wherein the lignin is agglomerated and sorted out from the lignin-containing black liquor.

8. The pulp production process according to claim 1, wherein the hydrophilicizing step further comprises immersing the wood chips in water prior to the hydrophilicizing of the wood chips by immersing the wood chips into the dilute caustic soda aqueous solution.

9. The pulp production process according to claim 1, wherein the dilute nitric acid is added at room temperature then increased to 98° C.

10. The pulp production process according to claim 1, wherein the oxidizing step further includes blowing steam thereto.

11. The pulp production process according to claim 1, wherein the digesting step is executed at 95-100° C. for 30-120 minutes.

12. The pulp production process according to claim 1, further comprising a filtering/refining process of removing dirt and foreign materials.

13. The pulp production process according to claim 1, further comprising a bleaching step of bleaching the pulp by a chemical selected from the group consisting of chlorine, chlorine dioxide, oxygen, caustic soda, and sodium hypochlorite.

* * * * *